US007868742B2

(12) United States Patent
Shimizu

(10) Patent No.: US 7,868,742 B2
(45) Date of Patent: Jan. 11, 2011

(54) ON-BOARD EMERGENCY REPORTING APPARATUS AND AUXILIARY BATTERY DEVICE FOR THE SAME

(75) Inventor: Takashi Shimizu, Gamagori (JP)

(73) Assignee: Denso Corporation, Kariya (JP)

( * ) Notice: Subject to any disclaimer, the term of this patent is extended or adjusted under 35 U.S.C. 154(b) by 232 days.

(21) Appl. No.: 12/070,738

(22) Filed: Feb. 21, 2008

(65) Prior Publication Data

US 2008/0204262 A1 Aug. 28, 2008

(30) Foreign Application Priority Data

Feb. 23, 2007 (JP) ..... 2007-043855

(51) Int. Cl.
*G08B 1/00* (2006.01)

(52) U.S. Cl. ..... 340/309.16; 340/425.5; 340/428; 340/430; 340/693.1; 340/693.2

(58) Field of Classification Search ..... 340/309.16, 340/425.5, 426.1, 428, 429, 430, 426.11, 340/69.1, 693.2, 693.3, 693.4
See application file for complete search history.

(56) References Cited

U.S. PATENT DOCUMENTS

| | | | | |
|---|---|---|---|---|
| 2004/0075345 | A1* | 4/2004 | Yoshioka et al. | 307/66 |
| 2005/0181837 | A1 | 8/2005 | Sakai | |
| 2008/0088422 | A1 | 4/2008 | Sakai | |

FOREIGN PATENT DOCUMENTS

| | | |
|---|---|---|
| JP | 2000-097711 | 4/2000 |
| JP | 2000-222659 | 8/2000 |
| JP | 2000-227983 | 8/2000 |
| JP | 2000-322677 | 11/2000 |
| JP | 2001-006070 | 1/2001 |
| JP | 2003-123172 | 4/2003 |
| JP | 2004-038634 | 2/2004 |
| JP | 2007-059218 | 3/2007 |
| JP | 2007-079950 | 3/2007 |

OTHER PUBLICATIONS

Office Action dated Jun. 23, 2009 in corresponding Japanese Application No. 2007-043855.
Office Action dated Dec. 16, 2008 in Japanese Application No. 2007-043855.

* cited by examiner

*Primary Examiner*—Daryl Pope
(74) *Attorney, Agent, or Firm*—Harness, Dickey & Pierce, PLC

(57) ABSTRACT

An emergency reporting apparatus includes a power supply circuit, a control circuit, and a timer. The power supply circuit generates operating power of the emergency reporting apparatus from a vehicle battery in a vehicle battery mode and from an auxiliary battery in an auxiliary battery mode. The control circuit causes the power supply circuit to switch from the vehicle battery mode to the auxiliary battery mode in response to a trigger event and starts an emergency reporting procedure using the auxiliary battery. The timer measures time elapsed since the power supply circuit switches to the auxiliary battery mode. The control circuit causes the power supply circuit to switch back to the vehicle battery mode, when the elapsed time exceeds a predetermined threshold time period.

2 Claims, 5 Drawing Sheets

ON-BOARD EMERGENCY REPORTING APPARATUS AND AUXILIARY BATTERY DEVICE FOR THE SAME

CROSS REFERENCE TO RELATED APPLICATION

This application is based on and incorporates herein by reference Japanese Patent Application No. 200743855 filed on Feb. 23, 2007.

FIELD OF THE INVENTION

The present invention relates to an on-board emergency reporting apparatus and an auxiliary battery device used for the emergency reporting apparatus.

BACKGROUND OF THE INVENTION

In an on-board emergency reporting apparatus disclosed in US 2004/0075345 corresponding to JP-A-2000-322677, a power source for supplying operating power to the emergency reporting apparatus switches from a vehicle battery device to an auxiliary battery device when a voltage level of the vehicle battery device drops, for example, during engine starting. Thus, even when a trigger event for an emergency reporting procedure occurs during a period of time when the voltage level of the vehicle battery device is low, the emergency reporting apparatus can perform the emergency reporting procedure.

In another on-board emergency reporting apparatus disclosed in JP-A-2000-222659, if operating power supplied from a vehicle battery device to a power supply circuit of the emergency reporting apparatus is interrupted when a trigger event for an emergency reporting procedure occurs, the power supply circuit automatically switches from the vehicle battery device to an auxiliary battery device to receive the operating power from the auxiliary battery device.

In such conventional emergency reporting apparatus, the following problems may arise. If the power supply circuit remains instructed to receive the operating power from the auxiliary battery device even after completion of the emergency reporting procedure, the auxiliary battery device remains discharged. For example, when the auxiliary battery device is replaced with new one for the next emergency reporting procedure, the new auxiliary battery device is wastefully discharged. For further example, when the auxiliary battery device is continuously used without being replaced with new one, the charged of the auxiliary battery device is reduced to an insufficient level for the next emergency reporting procedure.

SUMMARY OF THE INVENTION

In view of the above-described problem, it is an object of the present invention to provide an on-board emergency reporting apparatus that prevents an auxiliary battery device from wastefully being discharged after completion of an emergency reporting procedure and to provide an auxiliary battery device used for the on-board emergency reporting apparatus.

According to a first aspect of the prevent invention, an emergency reporting apparatus for use in combination with an auxiliary battery device, which is attachable to and detachable from the emergency reporting apparatus, includes a power supply circuit, a control circuit, and a timer circuit. The power supply circuit has a vehicle battery mode and an auxiliary battery mode. The power supply circuit generates operating power of the emergency reporting apparatus from a vehicle battery in the vehicle battery mode and generates the operating power from the auxiliary battery device in the auxiliary battery mode. The control circuit causes the power supply circuit to switch from the vehicle battery mode to the auxiliary battery mode in response to a trigger event to start an emergency reporting procedure and starts the emergency reporting procedure by using the operating power generated from the auxiliary battery device. The timer circuit measures time elapsed since the power supply circuit switches from the vehicle battery mode to the auxiliary battery mode. The control circuit causes the power supply circuit to switch from the auxiliary battery mode back to the vehicle battery mode, when the elapsed time exceeds a predetermined amount of time.

According to a second aspect of the prevent invention, the emergency reporting apparatus includes a detection circuit instead of the timer circuit. The detection circuit detects a predetermined operation performed by a user. The control circuit causes the power supply circuit to switch from the auxiliary battery mode back to the vehicle battery mode, when the predetermined operation is detected after the emergency reporting procedure is started.

According to a third aspect of the prevent invention, an auxiliary battery device attachable to and detachable from an emergency reporting apparatus, which is configured to perform an emergency reporting procedure by using an electric power supplied from the auxiliary battery device, includes a battery cell, a control circuit, and a timer circuit. The control circuit starts a supply of the electric power from the battery cell to the emergency reporting apparatus in response to a trigger event that is occurred in the emergency reporting apparatus and causes the emergency reporting procedure to be stated. The timer circuit measures time elapsed since the supply of the electric power from the battery cell to the emergency reporting is started. The control circuit stops the supply of the electric power from the battery cell to the emergency reporting apparatus, when the elapsed time exceeds a predetermined amount of time.

According to a fourth aspect of the prevent invention, the auxiliary battery device includes a detection circuit instead of the timer circuit. The detection circuit detects a predetermined operation performed by a user. The control circuit stops the supply of the electric power from the battery cell to the emergency reporting apparatus, when the predetermined operation is detected.

BRIEF DESCRIPTION OF THE DRAWINGS

The above and other objectives, features and advantages of the present invention will become more apparent from the following detailed description made with check to the accompanying drawings. In the drawings.

DETAILED DESCRIPTION OF THE PREFERRED EMBODIMENTS

First Embodiment

Figure 1:
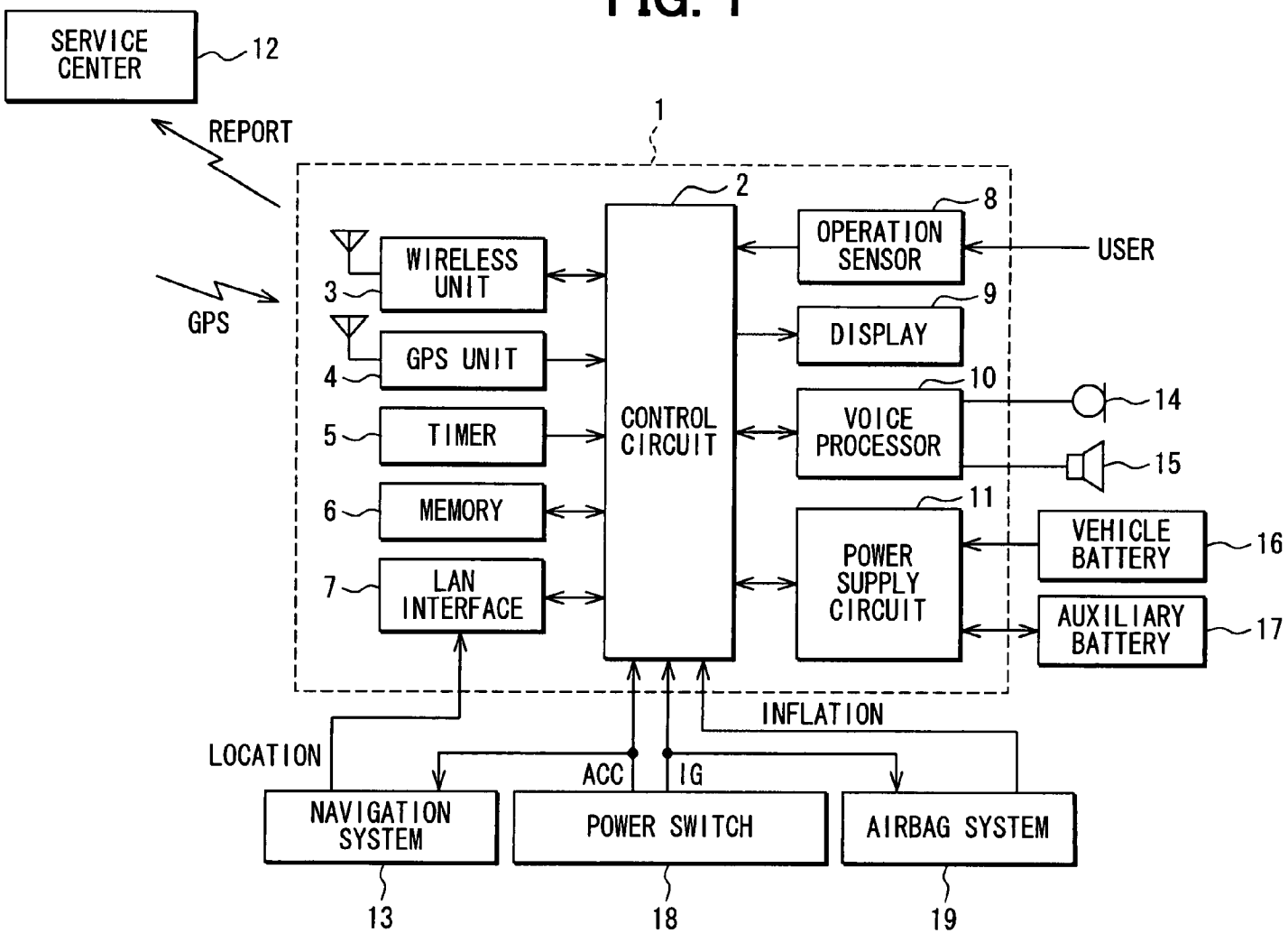
FIG. 1 is a functional block diagram illustrating an on-board emergency reporting apparatus and an auxiliary battery device according to a first embodiment of the present invention.

Referring to FIG. 1, an on-board emergency reporting apparatus 1 according to a first embodiment of the present invention includes a control circuit 2, a wireless communication unit 3, a global positioning system (GPS) unit 4, a timer circuit 5, a memory device 6, a local area network (LAN) interface 7, an operation sensor 8, a display unit 9, a voice processor 10, and a power supply circuit 11.

The control circuit 2 is mainly constructed with a central processing unit (CPU) and controls the entire operation of the emergency reporting apparatus 1. When receiving an emergency reporting command from the control circuit 2, the wireless communication unit 3 establishes a voice communication line with a service center 12 and sends an emergency reporting signal to the service center via a wireless communication network. In this case, the wireless communication unit 3 switches between a voice communication and a data communication with the voice communication line established so that a user in the vehicle can perform both the voice communication and the data communication with an operator in the service center 12.

The GPS unit 4 receives a GPS signal from a GPS satellite and produces first location data of the vehicle based on the GPS signal. When receiving a count command from the control circuit 2, the timer circuit 5 starts to count time. The memory device 6 stores various data. The LAN interface 7 receives second location data of the vehicle from a navigation system 13. The navigation system 13 produces the second location data based on multiple signals including the GPS signal, a G sensor signal, and a speed sensor signal. Therefore, an accuracy of the second location data produced by the navigation system 13 is higher than that of the first location data produced by the GPS unit 4.

When detecting that the user performs a predetermined operation, the operation sensor 8 outputs an operation detection signal to the control circuit 2. When receiving a display command from the control circuit 2, the display unit 9 displays data on a screen in accordance with the display command. The voice processor 10 processes a transmitted voice inputted to a microphone 14 and a received voice outputted from a speaker 15. The user in the vehicle can have a conversation with the operator in the service center 12 using the microphone 14 and the speaker 15. Thus, the user can make an oral request for help and an oral report on circumstances of an accident, for example.

A power switch 18 includes an ignition (IG) switch and an accessory (ACC) switch. The power switch 18 outputs an IG signal indicative of an ON/OFF state of the IG switch to the control circuit 2 and an airbag system 19. The power switch 18 also outputs an ACC signal indicative of an ON/OFF state of the ACC switch to the control circuit 2 and the navigation system 13. The control circuit 2 operates in a normal mode, when the ACC signal indicates that the ACC switch is on. The control circuit 2 operates in a standby mode, when the ACC signal indicates that the ACC switch is off. A power consumption of the emergency reporting apparatus 1 is less in the standby mode than in the normal mode.

The navigation system 13 is turned on and off in accordance with the ACC signal received from the power switch 18. The airbag system 19 outputs an airbag inflation signal to the control circuit 2, when an airbag is inflated under the condition where the IG signal indicates that the IG switch is on.

Figure 2:
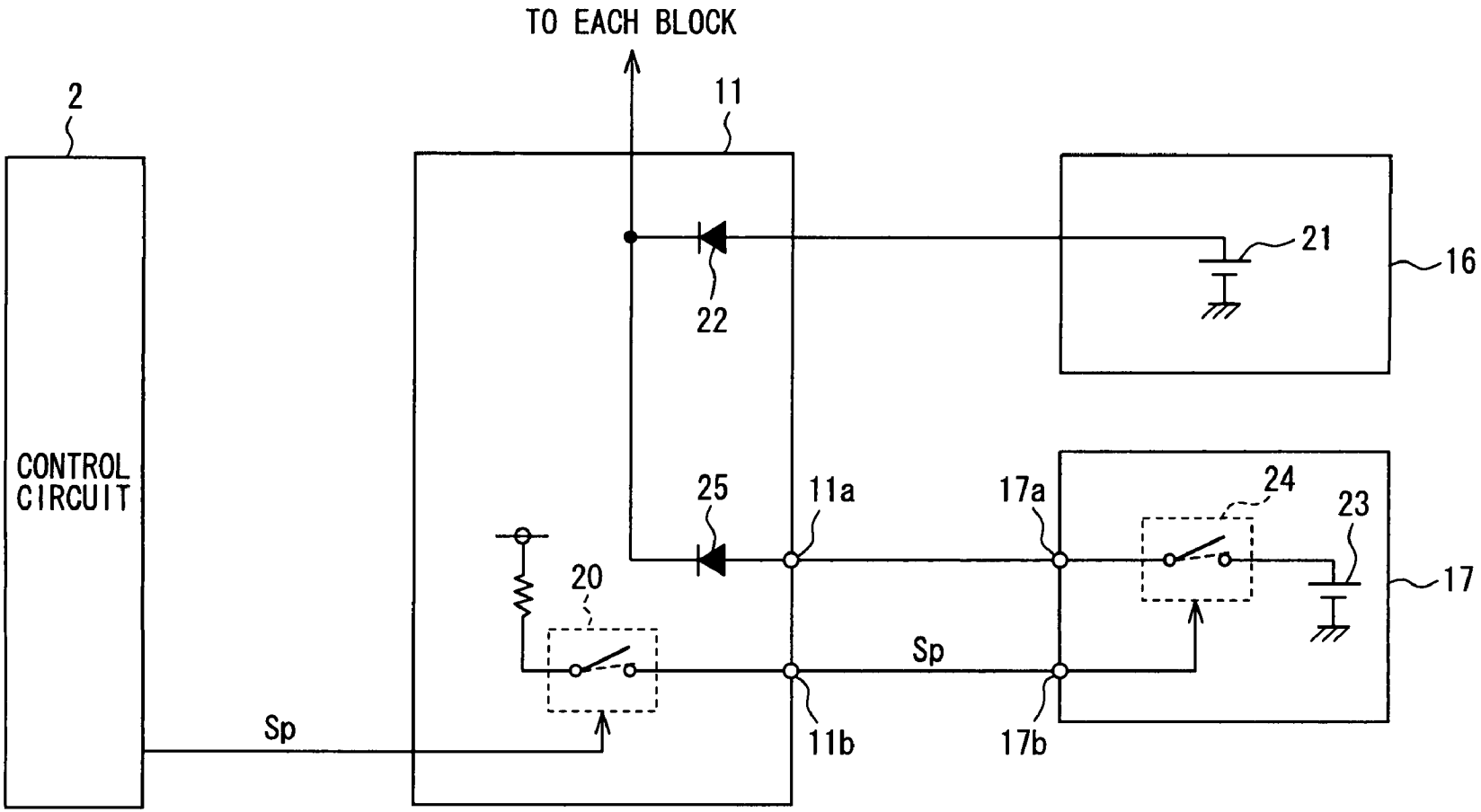
FIG. 2 is a schematic diagram illustrating a power supply circuit in the emergency reporting apparatus, the auxiliary battery device, and a vehicle battery device of FIG. 1.

The power supply circuit 11 of the emergency reporting apparatus 1, a vehicle battery device 16, and an auxiliary battery device 17 are described below with further reference to FIG. 2. The auxiliary battery device 17 is constructed with a primary cell and attachable to and detachable from the emergency reporting apparatus 1. When the auxiliary battery device 17 is attached to the emergency reporting apparatus 1, a power terminal 17*a* of the auxiliary battery device 17 is electrically coupled to a power terminal 11*a* of the power supply circuit 11, and a signal input terminal 17*b* of the auxiliary battery device 17 is electrically coupled to a signal output terminal 11*b* of the power supply circuit 11.

The power supply circuit 11 includes a selector switch 20 and selectively switches between a vehicle battery device supply mode and an auxiliary battery device supply mode by truing on and off the selector switch 20. Specifically, in a normal condition where the power supply circuit 11 does not receive a power supply command Sp from the control circuit 2, the power supply circuit 11 keeps the selector switch 20 in a off position as indicated by a solid line in FIG. 2. Accordingly, the auxiliary battery device 17 does not receive the power supply command Sp from the power supply circuit 11 so that a selector switch 24 of the auxiliary battery device 17 is kept off as indicated by a solid line in FIG. 2. Therefore, the power supply circuit 11 is supplied with power from a cell 21 of the vehicle battery device 16 and feeds the supplied power to each functional block through a diode 22. When receiving the power supply command Sp from the control circuit 2, the power supply circuit 11 turns on the selector switch 20 as indicated by a broken line in FIG. 2 and transmits the power supply command Sp to the selector switch 24 of the auxiliary battery device 17. In response to the power supply command Sp, the selector switch 24 is turned on as indicated by a broken line in FIG. 2. Therefore, the power supply circuit 11 is supplied with power from a cell 23 of the auxiliary battery device 17 and feeds the supplied power to each functional block through a diode 25.

A trigger event for an emergency reporting procedure occurs, for example, when the airbag inflation signal is outputted from the airbag system 19 to the control circuit 2. Upon reception of the airbag inflation signal, the control circuit 2 outputs the power supply command Sp to the power supply circuit 11 to cause the power supply circuit 11 to switch from the vehicle battery device 16 to the auxiliary battery device 17. Thus, the control circuit 2 performs the emergency reporting procedure using the power supplied from the auxiliary battery device 17. For example, in the emergency reporting procedure, the control circuit 2 causes the wireless communication unit 3 to transmit an emergency reporting signal containing first and second location data of the vehicle to the service center 12 via the wireless communication network.

Figure 3:
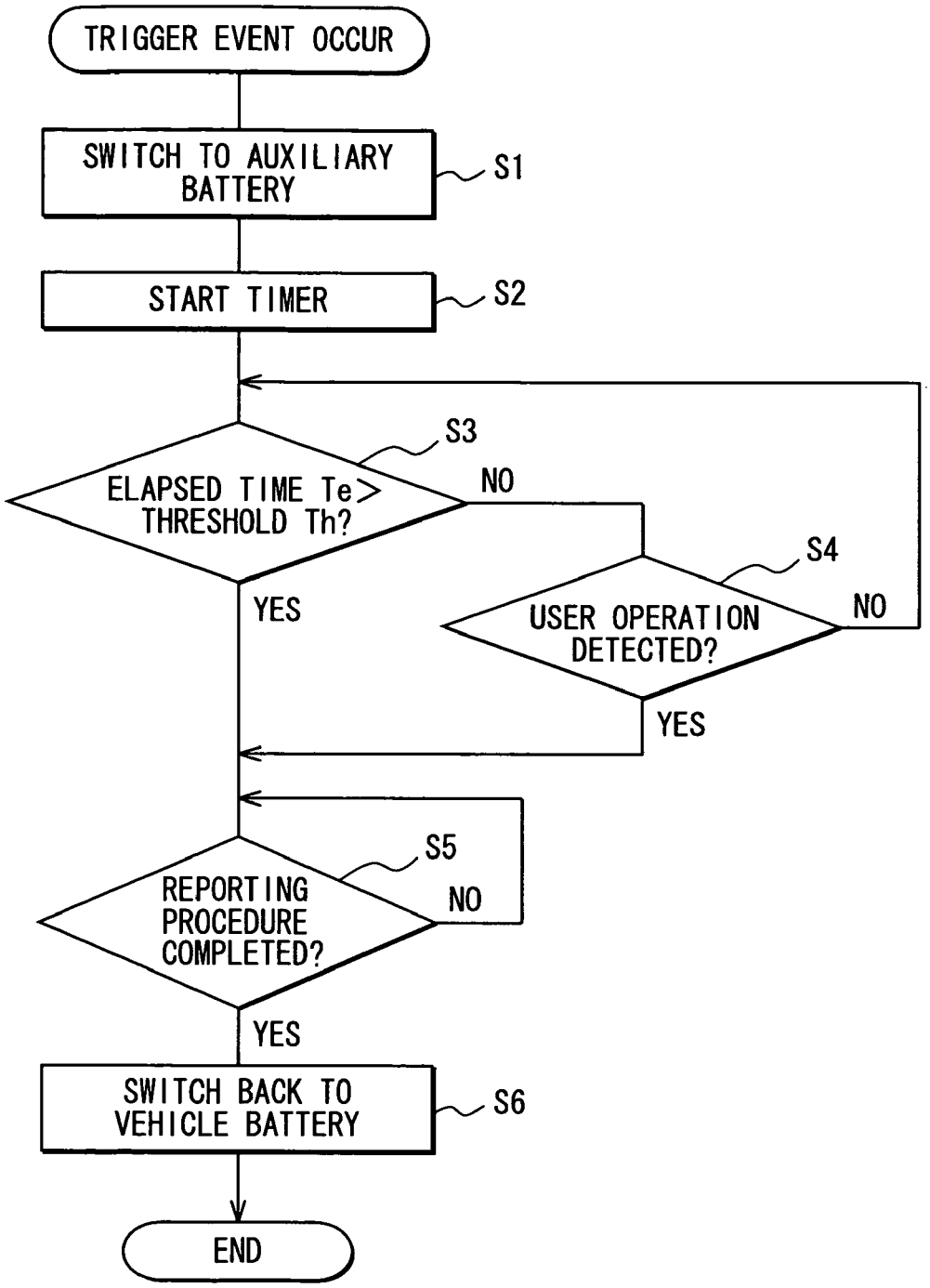
FIG. 3 is a flow diagram illustrating a process performed by a control circuit of the emergency reporting apparatus of FIG. 1.

The control circuit 2 of the emergency reporting apparatus 1 performs a process illustrated by a flow diagram of FIG. 3. When the control circuit 2 determines that the trigger event for the emergency reporting procedure occurs, the process starts at step S1. At step S1, the control circuit 2 outputs the power supply command Sp to the power supply circuit 11 to cause the power supply circuit 11 to switch from the vehicle battery device 16 to the auxiliary battery device 17. Thus, the control circuit 2 starts the emergency reporting procedure using power supplied from the auxiliary battery device 17.

Then, the process proceeds to step S2, where the control circuit 2 causes the timer circuit 5 to start to measure time. Then, the process proceeds to step S3, where the control circuit 2 determines whether a time Te elapsed since the power supply circuit 11 switched to the auxiliary battery device 17 exceeds a predetermined threshold time period Th. The threshold time period Th is set such that the emergency reporting procedure can be finished within the threshold time period Th. The threshold time period Th is factory preset such that the emergency reporting procedure can be finished within the threshold time period Th. Alternatively, the threshold time period Th can be set by the user such that the emergency reporting procedure can be finished within the threshold time period Th.

If the elapsed time Te has already exceeded the threshold time period Th corresponding to YES at step S3, the process proceeds to step S5. If the elapsed time Te has not exceeded the threshold time period Th yet corresponding to NO at step S3, the process proceeds to step S4, where the control circuit 2 determines whether the operation sensor 8 detects the predetermined operation performed by the user. If the operation sensor 8 does not detect the predetermined operation performed by the user corresponding to NO at step S4, the process returns to step S3. If the operation sensor 8 detects the predetermined operation performed by the user corresponding to YES at step S4, the process proceeds to step S5.

As step S5, the control circuit 2 determines whether the emergency reporting procedure has been already finished. If the emergency reporting procedure has not been finished yet corresponding to NO at step S5, the process repeats step S5 until the emergency reporting procedure is finished. If the emergency reporting procedure has been already finished corresponding to YES at step S5, the process proceeds to step S6. As step S6, the control circuit 2 stops the output of the power supply command Sp to the power supply circuit 11 and causes the power supply circuit 11 to switch from the auxiliary battery device 17 back to the vehicle battery device 16. Then, the process is completed.

In a case where new trigger event for an emergency reporting procedure occurs before the emergency reporting procedure caused by the previous trigger event is finished, the control circuit 2 resets the timer circuit 5 so that the timer circuit 5 starts to measure time from the beginning.

As described above, according to the first embodiment, when the trigger event for the emergency reporting procedure occurs, the power supply command Sp is outputted to the auxiliary battery device 17 so that the control circuit 2 starts the emergency reporting procedure using power supplied from the auxiliary battery device 17.

When the time Te elapsed since the power supply circuit 11 switches from the vehicle battery device supply mode to the auxiliary battery device supply mode exceeds the threshold time period Th or when the user performs the predetermined operation, the output of the power supply command Sp to the auxiliary battery device 17 is stopped so that the supply of power from the auxiliary battery device 17 to the power supply circuit 11 can be stopped. In such an approach, when the auxiliary battery device 17 is replaced with new one after the emergency reporting procedure is finished, the replaced new auxiliary battery device 17 can be prevented from supplying power to the emergency reporting apparatus 1. Thus, the replaced new auxiliary battery device 17 can be prevented from wastefully discharging so that charge of the replaced new auxiliary battery device 17 can be suitably maintained.

Further, according to the first embodiment, the power supply command Sp is continuously outputted to the auxiliary battery device 17 until the emergency reporting procedure is finished. In such an approach, the emergency reporting procedure can be surely completed.

Second Embodiment

Figure 4:
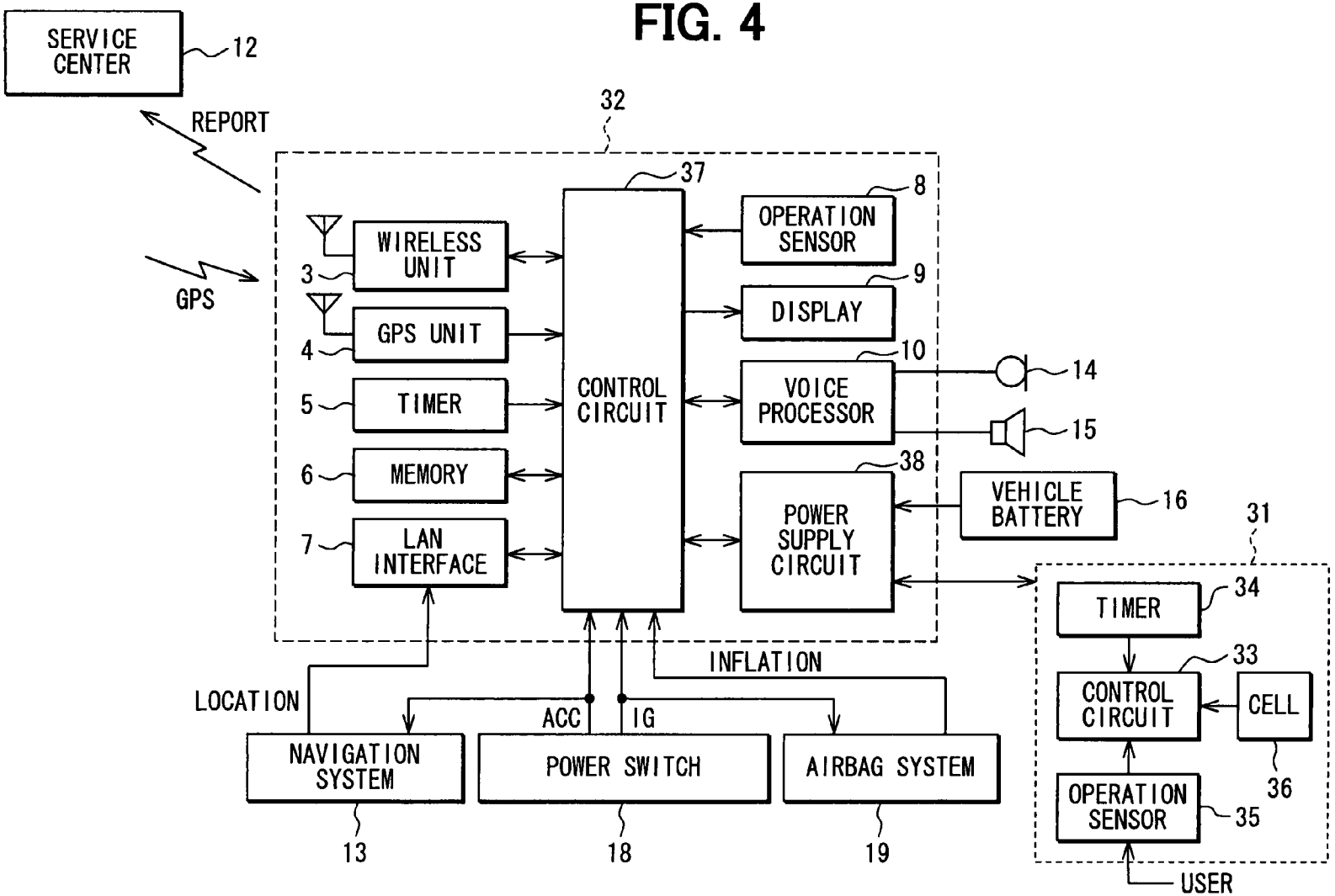
FIG. 4 is a functional block diagram illustrating an on-board emergency reporting apparatus and an auxiliary battery device according to a second embodiment of the present invention.

An emergency reporting apparatus 32 according to a second embodiment of the present invention is described below with reference to FIGS. 4, 5. A difference between the first and second embodiments is as follows. In the first embodiment, the emergency reporting apparatus 1 controls the power supply from the auxiliary battery device 17 to the emergency reporting apparatus 1. In contrast, in the second embodiment, an auxiliary battery device 31 controls power supply from the auxiliary battery device 31 to the emergency reporting apparatus 32.

The emergency reporting apparatus 32 includes a control circuit 37 instead of the control circuit 2 and includes a power supply circuit 38 instead of the power supply circuit 11. The auxiliary battery device 31 is attachable to and detachable from the emergency reporting apparatus 32 and includes a control circuit 33, a timer circuit 34, and an operation sensor 35, and a cell 36.

Like the first embodiment, the trigger event for the emergency reporting procedure occurs, for example, when the airbag inflation signal is outputted from the airbag system 19 to the control circuit 37 of the emergency reporting apparatus 32. Upon reception of the airbag inflation signal, the control circuit 37 outputs the power supply command Sp to the power supply circuit 38 to cause the power supply circuit 38 to switch from the vehicle battery device 16 to the auxiliary battery device 31. Thus, the control circuit 37 performs the emergency reporting procedure using power supplied from the auxiliary battery device 31. For example, in the emergency reporting procedure, the control circuit 37 causes the wireless communication unit 3 to transmit the emergency reporting signal containing the first and second location data of the vehicle to the service center 12 via the wireless communication network.

Figure 5:
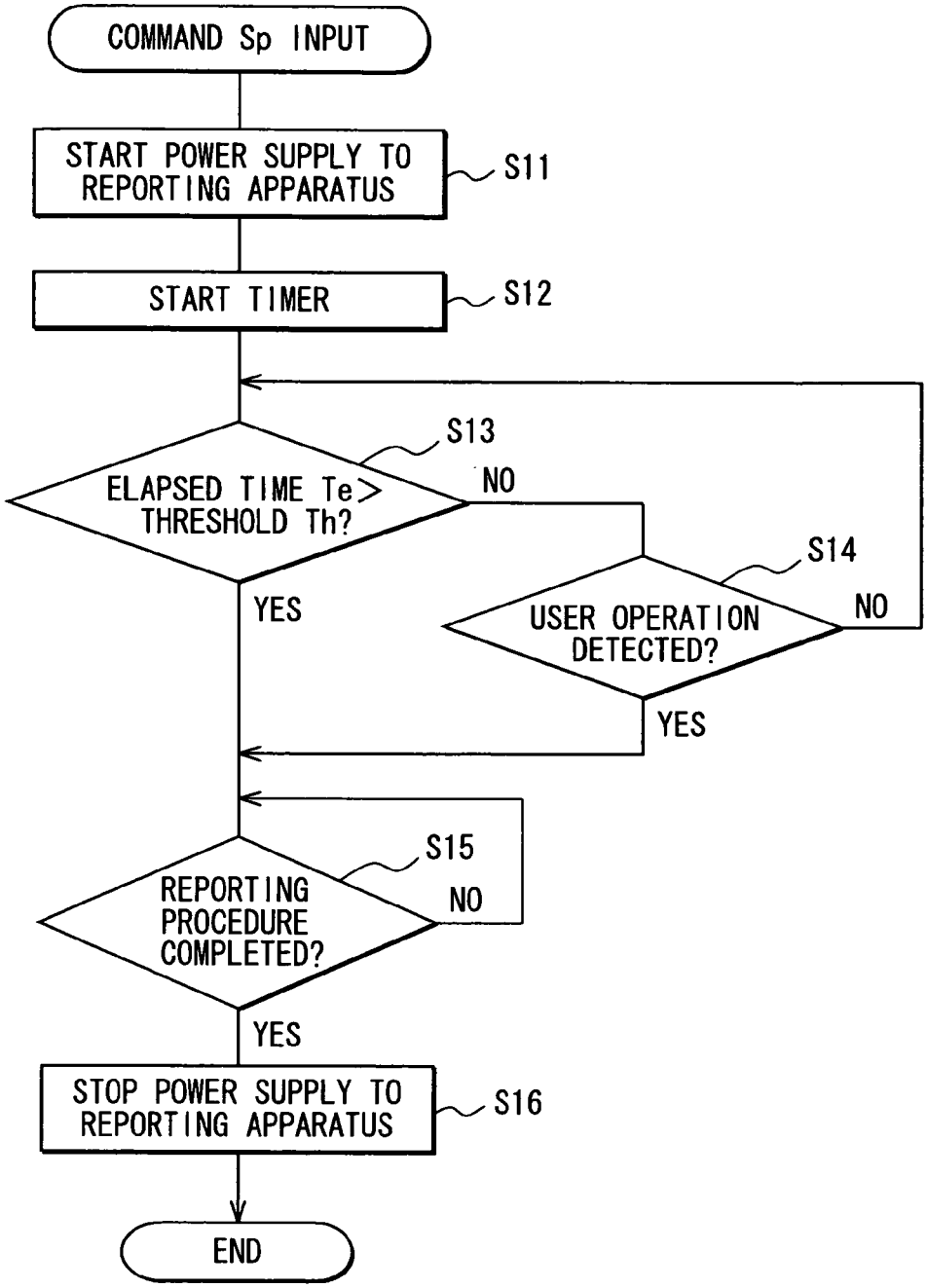
FIG. 5 is a flow diagram illustrating a process performed by a control circuit of the auxiliary battery device of FIG. 4.

The control circuit 33 of the auxiliary battery device 31 performs a process illustrated by a flow diagram of FIG. 5. When the control circuit 33 determines that the power supply command Sp is received from the emergency reporting apparatus 32, the process starts at step S1.

At step S11, the control circuit 33 causes the cell 36 to supply power to the emergency reporting apparatus 32. Thus, the control circuit 33 starts the emergency reporting procedure using the power supplied from the auxiliary battery device 31.

Then, the process proceeds to step S12, where the control circuit 33 causes the timer circuit 34 to start to measure time. Then, the process proceeds to step S13, where the control circuit 33 determines whether a time Te elapsed since the cell 36 of the auxiliary battery device 31 started to supply the power to the emergency reporting apparatus 32 exceeds a predetermined threshold time period Th. The threshold time period Th is set such that the emergency reporting procedure can be finished within the threshold time period Th. The threshold time period Th is factory preset such that the emergency reporting procedure can be finished within the threshold time period Th. Alternatively, the threshold time period Th can be set by the user such that the emergency reporting procedure can be finished within the threshold time period Th.

If the elapsed time Te has already exceeded the threshold time period Th corresponding to YES at step S13, the process proceeds to step S15. If the elapsed time Te has not exceeded the threshold time period Th yet corresponding to NO at step S13, the process proceeds to step S14, where the control circuit 33 determines whether the operation sensor 35 detects a predetermined operation performed by the user. If the operation sensor 35 does not detect the predetermined operation performed by the user corresponding to NO at step S14, the process returns to step S13. If the operation sensor 35 detects the predetermined operation performed by the user corresponding to YES at step S14, the process proceeds to step S15.

As step S15, the control circuit 33 determines whether the emergency reporting procedure has been already finished. If the emergency reporting procedure has not been finished yet corresponding to NO at step S15, the process repeats step S15 until the emergency reporting procedure is finished. If the emergency reporting procedure has been already finished corresponding to YES at step S15, the process proceeds to step S16. At step S16, the control circuit 33 stops the supply of power from the cell 36 to the emergency reporting apparatus 32.

In a case where new trigger event for an emergency reporting procedure occurs before the emergency reporting procedure caused by the previous trigger event is finished, the control circuit 33 resets the timer circuit 34 so that the timer circuit 34 restarts to measure time from the beginning.

As described above, according to the second embodiment, when the trigger event for the emergency reporting procedure occurs in the emergency reporting apparatus 32, the control circuit 33 of the auxiliary battery device 31 starts the supply of the power from the cell 36 to the emergency reporting apparatus 32. When the time Te elapsed since the supply of the power from the cell 36 to the emergency reporting apparatus 32 is started exceeds the threshold time period Th or when the user performs the predetermined operation, the supply of the power from the cell 36 to the emergency reporting apparatus 32 is stopped. Thus, it can be ensured that the supply of the power from the cell 36 to the emergency reporting apparatus 32 is stopped after the emergency reporting procedure is finished. In such an approach, when the auxiliary battery device 31 is used again without being replaced with new one, the remaining charge of the auxiliary battery device 31 can be suitably maintained.

Further, according to the second embodiment, the supply of the power from the cell 36 to the emergency reporting apparatus 32 is continued until the emergency reporting procedure is finished. In such an approach, the emergency reporting procedure can be surely completed. Furthermore, since the supply of the power from the cell 36 to the emergency reporting apparatus 32 is stopped immediately after the emergency reporting procedure is finished, the remaining charge of the auxiliary battery device 31 can be suitably maintained.

(Modifications)

The embodiments described above may be modified in various ways. For example, the emergency reporting apparatus 1, 32 can be provided as a separate unit or built into the vehicle as a module. The user can perform the predetermined operation by using a specific terminal device coupled to the emergency reporting apparatus 1 or the auxiliary battery device 31. The trigger event for the emergency reporting procedure can be caused by a system other than the airbag system 19. When the power source of the emergency reporting apparatus 1, 32 switches between the vehicle battery device 16 and the auxiliary battery devices 17, 31, a notice to inform the user that the switching is performed can be displayed on the display unit 9.

Such changes and modifications are to be understood as being within the scope of the present invention as defined by the appended claims.

What is claimed is:

1. An emergency reporting apparatus for use in combination with an auxiliary battery device attachable to and detachable from the emergency reporting apparatus, the emergency reporting apparatus comprising:

a power supply circuit having a vehicle battery mode and an auxiliary battery mode, the power supply circuit being configured to generate operating power of the emergency reporting apparatus from a vehicle battery in the vehicle battery mode and generate the operating power from the auxiliary battery device in the auxiliary battery mode;

a control circuit configured to cause the power supply circuit to switch from the vehicle battery mode to the auxiliary battery mode in response to a trigger event to start an emergency reporting procedure, the control circuit starting the emergency reporting procedure by using the operating power generated from the auxiliary battery device; and a timer circuit configured to measure time elapsed since the power supply circuit switches from the vehicle battery mode to the auxiliary battery mode, wherein the control circuit causes the power supply circuit to switch from the auxiliary battery mode back to the vehicle battery mode, when the elapsed time exceeds a predetermined threshold time period.

2. The emergency reporting apparatus according to claim 1, wherein the control circuit keeps the power supply circuit in the auxiliary battery mode until the emergency reporting procedure is completed, regardless of whether the elapsed time exceeds the threshold time period.

* * * * *